US008365549B2

(12) United States Patent
Civanelli

(10) Patent No.: US 8,365,549 B2
(45) Date of Patent: Feb. 5, 2013

(54) DEVICE FOR CONTROLLING THE REFRIGERATION AND HUMIDITY INSIDE A DRAWER MOVABLE WITHIN A REFRIGERATOR

(75) Inventor: Claudio Civanelli, Travedona Monate (IT)

(73) Assignee: Whirlpool Corporation, Benton Harbor, MI (US)

( * ) Notice: Subject to any disclaimer, the term of this patent is extended or adjusted under 35 U.S.C. 154(b) by 1210 days.

(21) Appl. No.: 11/954,191

(22) Filed: Dec. 11, 2007

(65) Prior Publication Data

US 2008/0134712 A1 Jun. 12, 2008

(30) Foreign Application Priority Data

Dec. 11, 2006 (IT) ..... MI2006A2365

(51) Int. Cl.

| | |
|---|---|
| ***F25D 25/02*** | (2006.01) |
| ***F25D 17/04*** | (2006.01) |
| ***F25B 49/00*** | (2006.01) |
| ***A47F 3/04*** | (2006.01) |

(52) U.S. Cl. ..... 62/382; 62/176.6; 62/251; 62/255; 62/407

(58) Field of Classification Search ..... 62/176.6, 62/382, 407, 251, 255
See application file for complete search history.

(56) References Cited

U.S. PATENT DOCUMENTS

| | | | | |
|---|---|---|---|---|
| 2,192,348 | A * | 3/1940 | James | 62/176.6 |
| 3,364,694 | A * | 1/1968 | Cohen et al. | 62/265 |
| 3,600,905 | A * | 8/1971 | Dymek et al. | 62/132 |
| 4,984,433 | A * | 1/1991 | Worthington | 62/90 |
| 5,168,719 | A * | 12/1992 | Branz et al. | 62/258 |
| 5,212,962 | A * | 5/1993 | Kang et al. | 62/382 |
| 5,983,654 | A * | 11/1999 | Yamamoto et al. | 62/187 |
| 6,189,325 | B1 * | 2/2001 | Pittion et al. | 62/176.3 |
| 6,223,553 | B1 | 5/2001 | Albert et al. | |
| 6,385,990 | B1 * | 5/2002 | Lee | 62/407 |
| 6,401,481 | B2 * | 6/2002 | Hiraoka et al. | 62/407 |
| 6,463,752 | B2 | 10/2002 | Mandel et al. | |
| 6,675,603 | B1 * | 1/2004 | Lesyna et al. | 62/407 |

FOREIGN PATENT DOCUMENTS

WO 2004038312 A1 5/2004

OTHER PUBLICATIONS

European Patent Application No. 07120441.6, Applicant: Whirlpool Corporation, Publication No. EP1936302A1, publication date: Jun. 25, 2008.

* cited by examiner

*Primary Examiner* — Marc Norman
*Assistant Examiner* — Filip Zec
(74) *Attorney, Agent, or Firm* — Kirk W. Goodwin; Diederiks & Whitelaw PLC

(57) ABSTRACT

A device for controlling the refrigeration and humidity inside a drawer movable within a compartment of a refrigerator, the drawer being insertable into the forced-air compartment provided in a cabinet of the refrigerator, the compartment receiving cold air forced through a feed conduit provided in the cabinet. The conduit is divided into a plurality of channels, one opening into a side wall of the compartment, and at least one other opening at an upper wall of the compartment above the drawer, in the channels an interceptor member is provided to allow control of the air flow passing through it and directed to the compartment for the drawer.

21 Claims, 1 Drawing Sheet

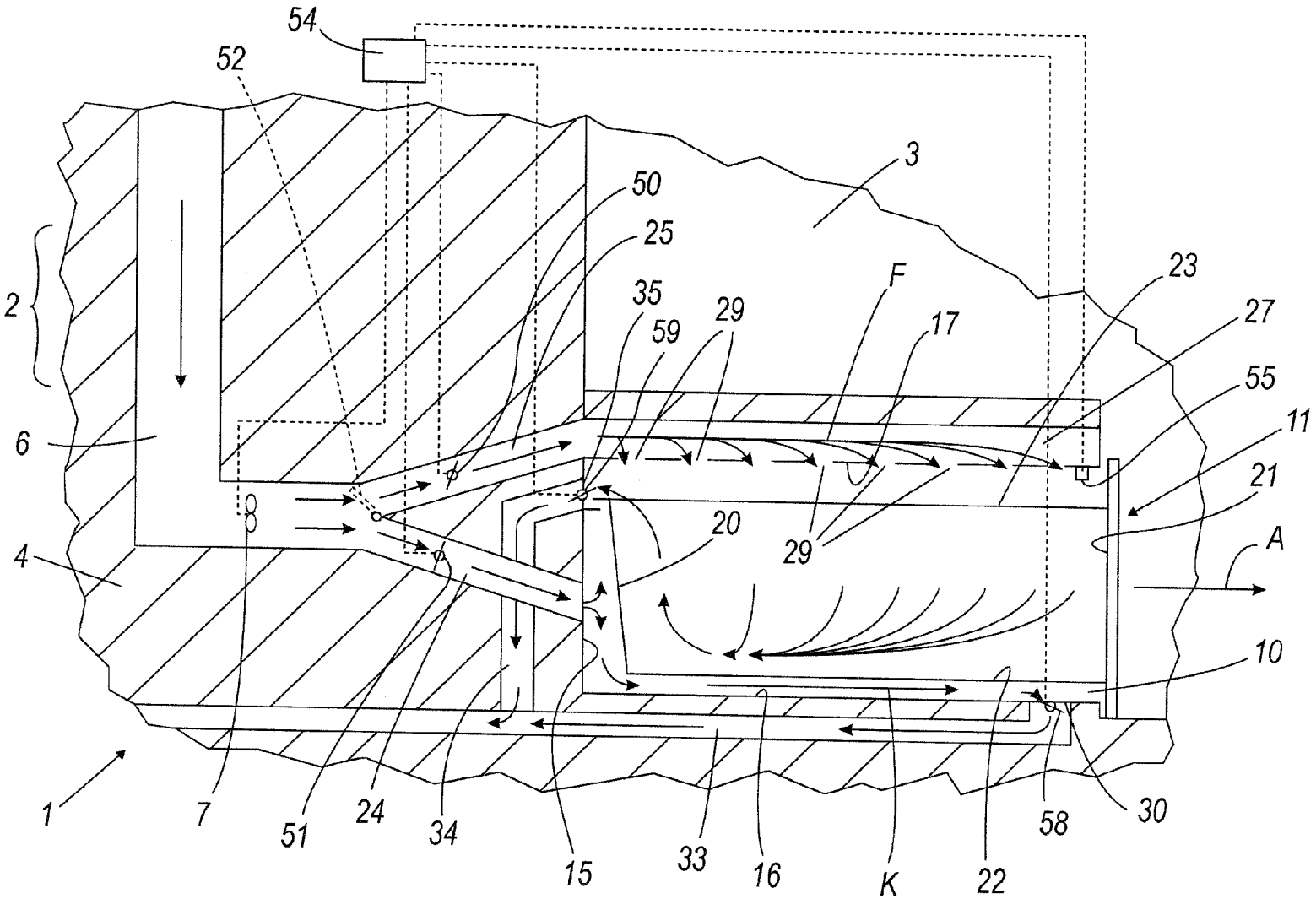
1
2
3
4
6
7
10
11
15
16
17
20
21
22
23
24
25
27
29
29
30
33
34
35
50
51
52
54
55
58
59
A
F
K

DEVICE FOR CONTROLLING THE REFRIGERATION AND HUMIDITY INSIDE A DRAWER MOVABLE WITHIN A REFRIGERATOR

BACKGROUND OF THE INVENTION

1. Field of the Invention

The present invention relates to a device for controlling the refrigeration and humidity inside a drawer movable within a forced-air compartment of a refrigerator.

Refrigerators (single or double door upright) provided with a compartment in which a drawer for preserving fruit, vegetables, meat or fish is movable have been known for some time. This compartment may or may not be of forced-air type, it may be inside a preservation compartment of the refrigerator or be external to it and disposed between it and a freezer compartment. In this latter case, a door for the compartment provided with the drawer is present and is disposed directly on the refrigerator cabinet where the doors for the other refrigerator compartments are also present.

2. Description of the Related Art

With reference to forced-air refrigerators, it is known to also direct an air flow directly towards the compartment with the movable drawer. U.S. Pat. No. 6,223,553 describes a forced-air refrigerator provided with a preservation compartment containing a compartment housing a movable drawer. This US patent states that the drawer is grazed on several sides by a forced air circulation, this air entering the corresponding compartment and leaving it through suitable apertures.

In contrast, KR1027236 describes a drawer inserted into a refrigerator preservation compartment and into which an air flow can be introduced by automatically opening a refrigerated air flow regulator plate (provided on the drawer) which is able to selectively connect, to the interior of the drawer, a conduit (provided in the refrigerator cabinet) through which refrigerated air moves. The Korean text hence describes a solution in which the cold air can enter the drawer and graze the foods contained in it.

SUMMARY OF THE INVENTION

The previous provided solutions present various drawbacks. In this respect, it is known that refrigeration air is very cold (originating from a freezer compartment usually at about −18°) and has a very low absolute humidity even if the relative humidity is close to 100%. When this air is introduced into the movable drawer in considerable quantity so that it grazes the foods placed therein (as in KR1027236), it extracts sensible heat from the foods, to increase its own temperature while at the same time reduce its relative humidity. Consequently the air introduced into the drawer increases its own capacity to remove moisture from the foods, so tending to dehydrate them.

In contrast, if the cold air copiously grazes only the outside of the drawer by passing through an interspace between it and the respective compartment (as in U.S. Pat. No. 6,223,553), the moisture within the foods contained in the drawer remains substantially unaltered. This moisture tends towards a 100% humidity level, at which it condenses on the (cold) walls of the drawer to form an undesirable layer of water which then falls onto the base of the drawer to contact the folds lying on it, or if the temperature of the drawer wall is equal to or less than approximately 0° C., it becomes frost or ice.

In both cases there is a negative effect on the preservation of the foods contained in the movable drawer.

An object of the present invention is to provide a device which enables the refrigeration and humidity within a movable drawer of a refrigerator to be controlled in an optimal manner.

A particular object of the present invention is to provide a device of the stated type which is of simple construction and reliable use.

These and other objects which will be apparent to the expert of the art are attained by a device in accordance with the accompanying claims.

BRIEF DESCRIPTION OF THE DRAWINGS

The present invention will be more apparent from the accompanying drawing, which is provided by way of non-limiting example and in which the sole FIGURE shows a partial schematic longitudinal section through a refrigerator provided with a device according to the invention.

DETAILED DESCRIPTION OF THE PREFERRED EMBODIMENTS

With reference to the FIGURE, the reference numeral 1 indicates generally a refrigerator having a cabinet 2 in which a food preservation compartment 3 is provided. The cabinet comprises an interspace 4 which carries usual insulating material and in which a conduit 6 is provided for forced air circulation by the action of an electric fan 7. The refrigerator also comprises a compartment 10 which houses a movable drawer 11 and to which the forced air arrives from the conduit 6.

According to the invention, to maintain an optimum humidity level (depending on the food, typically from 75% to 95% relative humidity) within the drawer for food preservation, a selective forcer-air circulation is provided through the drawer and between it and the compartment 10.

More specifically, the compartment 10 comprises a rear wall 15 (with reference to the opening direction of the drawer 11 indicated by the arrow A), a lower wall 16, an upper wall 17 and side walls (not visible in the FIGURE). The drawer 11 comprises a base wall 20, a front wall 21, a lower wall 22 and side walls (not shown), and is open upperly at its top 23.

A channel 24 connected to the conduit 6 opens into the rear wall 15 of the compartment 10 in front of the wall 20 of the drawer 11, while another channel 25 again connected to this latter opens into an interspace 27 present at the upper wall 17 of the compartment 10. This latter wall is provided with apertures 29. Another aperture 30 is provided in the bottom 16 of the compartment 10, the aperture being connected to a channel 33 for discharging air from the compartment 10; to the channel 33 another channel 34 is connected opening at 35 into the rear wall 15 of the compartment 10, above the open upper part 23 of the drawer 11.

By virtue of the invention, the forced air which moves through the conduit 6 is directed by the channels 24 and 25 into a position to the rear of the drawer 11 and above this latter respectively, as shown by the arrows F and K. The air which enters the compartment 10 from the channel 24 is distributed about and below the drawer 11, to reach the aperture 30 from which it leaves to pass into the conduit 33 (again directed towards a refrigerator evaporator, not shown, from which the cold air returns to the conduit 6). At the same time, the air from the channel 25 passes into the interspace 27 and, after leaving via the apertures 29 of the upper wall 17 of the compartment 10, again falls into the drawer 11 where it can interact with the foods placed in it.

Hence by virtue of the invention, air circulation is obtained both within the drawer and around the outside of the drawer wall, the circulation being obtained by dividing the air flow circulating through the conduit 6 into several parts. This enables a suitable humidity value to be created within the drawer 11 and also enables dehydration of the foods placed in it and water formation on its lower wall 22 to be prevented.

To suitably adjust the air flow between the drawer and the walls of the compartment 10 and the air flow within the drawer to attain and maintain the desired relative humidity conditions, flow regulator valve means are provided in the channels 24 and 25. These means can be valves 50 and 51 positioned in these channels (as shown by full lines in the FIGURE) or a single valve 52 (shown dashed) positioned at the commencement of these channel where the conduit 6 terminates. These valves can be operated manually or be controlled automatically by a control unit 54, preferably of microprocessor type, on the basis of the relative humidity values measured in the compartment 10 by a humidity sensor 55 present therein (and shown schematically by way of example in the FIGURE at the wall 17 of the compartment 10). This unit also controls the fan 7.

Other flow regulator valve means could be provided, such as valves 58, 59 positioned in the channels 33 and 34 respectively, as shown in the FIGURE. If the unit 54 is provided, this latter also controls the position of the valves 58, 59 in the respective channels 33 and 34. If these valves 58 and 59 are present, the presence of the valves 50, 51 and 52 in the channels 24 and 25 can be avoided.

In a preferred embodiment, the temperature of the forced air compartment 10 is controlled by the unit 54 via a temperature sensor (not shown) and by controlling the fan 7.

By virtue of the arrangement of the channels 24, 25 and 33, 34 and of the valves 50, 51 or 52, or 58, 59, a correct humidity level can be obtained automatically or manually in the compartment 10 or in the drawer 11 such as to create optimum conditions for preservation of the foods placed therein.

In an embodiment for automatically regulating the humidity in the drawer inserted into the compartment according to the invention, the air flows regulated by the valves 50 or 59 are intensified compared with those regulated by the valves 51 or 58 when the measured humidity value is greater than the optimal regulation value until the optimal humidity conditions are re-established. Again, when the measured value is less than the optimal regulation value, the air flows regulated by the valves 51 or 58 are intensified compared with those regulated by the valves 50 or 59, until the optimal humidity conditions are re-established.

A preferred embodiment of the invention has been described; others are however conceivable by the expert of the art on the basis of the aforegoing description and are to be considered as falling within the scope of the ensuing claims.

I claim:

1. A drawer system in a refrigerator comprising:

a forced air compartment having rear, top, lower and side walls;

a drawer removably housed within the forced air compartment, the drawer including back, front, bottom and opposing side walls, as well as a top;

a refrigeration air conduit contained in the refrigerator and configured to supply cold air to the forced air compartment;

a controller;

a compartment air conduit, the compartment air conduit being divided into a plurality of channels, wherein the plurality of channels include:

a first channel which opens to the forced air compartment at a position below the top of the drawer and directs the cold air between at least one of the rear, lower and side walls of the forced air compartment and at least one of the back, bottom and opposing side walls of the drawer directly upon entrance of the cold air into the forced air compartment, a second channel which directs the cold air into the drawer, and at least one flow regulator valve configured to regulate flow of the cold air in the first and the second channels, wherein the at least one flow regulator valve is operatively connected to and regulated by the controller.

2. The drawer system according to claim 1, wherein the first channel further directs cold air between the forced air compartment and at least each of the back and bottom walls of the drawer.

3. The drawer system according to claim 2, wherein the first channel further directs cold air into the forced air compartment and above the back wall of the drawer.

4. The drawer system according to claim 1, wherein the second channel directs cold air through a series of back-to-front spaced openings provided in the top wall of the forced air compartment and into the drawer so the cold air can flow across a plurality of food items placed in the drawer.

5. The drawer system according to claim 1, further comprising a third channel which discharges cold air from the drawer.

6. The drawer system of claim 5, wherein the at least one flow regulator valve is in the third channel, said drawer system further comprising at least one additional flow regulator valve for at least one of the first and second channels.

7. The drawer system of claim 1 wherein the at least one flow regulator valve is in the compartment air conduit.

8. The drawer system of claim 1 wherein the at least one flow regulator valve is in the second channel.

9. The drawer system of claim 1, further comprising a humidity sensor within the drawer, wherein the humidity sensor is operatively connected to the controller.

10. The drawer system of claim 9 wherein the controller operates the at least one flow regulator valve based on a humidity level sensed by the humidity sensor.

11. The drawer system of claim 9, further comprising a temperature sensor operatively connected to the controller.

12. The drawer system of claim 11 wherein the controller operates the at least one flow regulator valve based on temperature and humidity values sensed by the temperature sensor and the humidity sensor respectively.

13. The drawer system of claim 12, wherein the controller is a microprocessor.

14. The drawer system of claim 1, wherein the controller is a microprocessor.

15. A method of cooling a drawer for food items comprising:

directing cold air from a conduit to a compartment defined by rear, top, lower and side walls, the compartment housing a removable drawer therein for storage of food items, the drawer having back, front, bottom and opposing side walls, as well as a top, wherein, directing the cold air from the conduit includes directing the cold air to at least two channels including:

a first channel which opens to the compartment at a position below the top of the drawer and directs the cold air between at least one of the rear, lower and side walls of the compartment and at least one of the back, bottom and opposing side walls of the drawer directly upon entrance of the cold air into the compartment, and a second channel which directs the cold air into the drawer; and regulating the directing of cold air in the at least two channels by at least one flow regulator valve.

16. The method of claim 15 wherein the at least one flow regulator valve is further regulated by a controller.

17. The method of claim 16 wherein the controller is a microprocessor.

18. The method of claim 17 wherein the controller is operatively connected to a temperature sensor located in the drawer and the controller regulates the at least one regulator valve based on sensed values of the temperature sensor.

19. The method of claim 18 wherein the controller is operatively connected to a humidity sensor located in the drawer and the controller regulates the at least one regulator valve based on sensed values of the humidity sensor.

20. The method of claim 17 wherein the controller is operatively connected to a humidity sensor located in the drawer and the controller regulates the at least one regulator valve based on sensed values of the humidity sensor.

21. A refrigerator comprising:

a microprocessor;

a compartment having rear, top, lower and side walls;

a movable drawer located within the compartment, the drawer including back, front, bottom and opposing side walls, as well as a top;

an air conduit configured to direct cold air to the compartment;

at least two air channels operatively connected to the air conduit, including:

a first channel which opens to the compartment at a position below the top of the drawer and directs cold air between at least one of the rear, lower and side walls of the compartment and at least one of the back, bottom and opposing side walls of the drawer directly upon entrance of the cold air into the compartment, and a second channel which directs cold air into the drawer;

at least one flow regulator valve configured to regulate flow of the cold air in the first and the second channels, wherein the at least one flow regulator valve is operatively connected to the microprocessor;

a humidity sensor operatively connected to the microprocessor wherein the humidity sensor is located in proximity to the drawer; and a temperature sensor operatively connected to the microprocessor wherein the temperature sensor is located in proximity to the drawer;

wherein the microprocessor causes the operation of the at least one flow regulator valve based on temperature and humidity values obtained from the temperature and humidity sensors, respectively.

* * * * *

UNITED STATES PATENT AND TRADEMARK OFFICE

CERTIFICATE OF CORRECTION

PATENT NO. : 8,365,549 B2
APPLICATION NO. : 11/954191
DATED : February 5, 2013
INVENTOR(S) : Claudio Civanelli It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1334 days.

Signed and Sealed this
Eighteenth Day of November, 2014

Michelle K. Lee

Michelle K. Lee
*Deputy Director of the United States Patent and Trademark Office*